US010910756B2

(12) United States Patent
Zhao et al.

(10) Patent No.: US 10,910,756 B2
(45) Date of Patent: Feb. 2, 2021

(54) ELECTRICAL CONNECTOR HAVING AN OUTER SHELL WITH A FRONT PORTION AND A REAR PORTION LARGER THAN THE FRONT PORTION

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Shao-Cong Zhou, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/584,969

(22) Filed: Sep. 27, 2019

(65) Prior Publication Data

US 2020/0106204 A1 Apr. 2, 2020

(30) Foreign Application Priority Data

Sep. 28, 2018 (CN) ..... 2018 1 1137728

(51) Int. Cl.
*H01R 13/502* (2006.01)
*H01R 13/6581* (2011.01)
*H01R 13/405* (2006.01)

(52) U.S. Cl.
CPC ..... *H01R 13/502* (2013.01); *H01R 13/405* (2013.01); *H01R 13/6581* (2013.01)

(58) Field of Classification Search
CPC . H01R 13/502; H01R 13/405; H01R 13/6581
(Continued)

(56) References Cited

U.S. PATENT DOCUMENTS 2,905,922 A * 9/1959 Tuchel ..... H01R 13/502 439/607.53
3,711,813 A * 1/1973 Bryant ..... H01R 13/502 334/44

(Continued)

FOREIGN PATENT DOCUMENTS

CN 207250814 4/2018
CN 207381608 5/2018

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

An electrical connector for inserting along a mating direction into a receiving space of a complementary connector through an insertion hole of an electronic device that has a dimension greater than that of the receiving space includes: an insulative housing; plural contacts secured to the insulative housing; and an outer shell enclosing the insulative housing, the outer shell including a front portion and a rear portion each having a respective lateral dimension measured along a transverse direction perpendicular to the mating direction, wherein the lateral dimension of the rear portion is greater than the lateral dimension of the front portion, the front portion is adapted to match the receiving space of the complementary connector and the rear portion is adapted to match the insertion hole of the electronic device, and the lateral dimension of the rear portion is less than the electronic device insertion hole dimension.

20 Claims, 9 Drawing Sheets

(58) Field of Classification Search
USPC ..... 439/676
See application file for complete search history.

(56) References Cited

U.S. PATENT DOCUMENTS 6,855,006 B2 * 2/2005 Brooks ..... H01R 13/405 439/606
8,696,382 B2 * 4/2014 Patel ..... H01R 12/58 439/607.1
8,714,994 B2 * 5/2014 Daily ..... H01R 24/64 439/344
8,851,919 B2 * 10/2014 Schutz ..... H01R 4/2433 439/405
9,356,400 B2 * 5/2016 Little ..... H01R 4/023
9,515,427 B2 * 12/2016 Wu ..... H01R 13/7175
9,647,396 B2 * 5/2017 Tsai ..... H01R 12/716
9,698,537 B2 * 7/2017 Yokoyama ..... H01R 13/648
9,705,269 B2 * 7/2017 Zhang ..... H01R 24/62
9,711,887 B1 * 7/2017 Hu ..... H01R 13/6583
9,728,885 B2 * 8/2017 Yokoyama ..... H01R 13/42
9,748,687 B2 * 8/2017 Yokoyama ..... H01R 4/02
9,780,495 B2 * 10/2017 Wu ..... H01R 4/023
9,837,769 B2 * 12/2017 Yu ..... H01R 12/716
9,887,484 B1 * 2/2018 Hu ..... H01R 13/502
9,935,398 B2 * 4/2018 Yokoyama ..... H01R 13/05
9,966,710 B2 * 5/2018 Chen ..... H01R 13/502
9,985,377 B2 * 5/2018 Peng ..... H01R 13/44
10,063,014 B2 * 8/2018 Wen ..... H01R 13/04
10,096,936 B2 * 10/2018 Ju ..... H01R 13/6275
10,103,491 B2 * 10/2018 Ju ..... H01R 13/04
10,128,608 B2 * 11/2018 Kasar ..... H01R 13/521
10,326,228 B2 * 6/2019 Yamanashi ..... H01R 13/03
10,411,410 B2 * 9/2019 Chang ..... H01R 13/6471
10,439,314 B2 * 10/2019 Chien ..... H01R 12/724
10,446,972 B2 * 10/2019 Ono ..... H01R 13/5216
2013/0115821 A1 * 5/2013 Golko ..... H04L 12/40013 439/638
2014/0295689 A1 * 10/2014 Zhao ..... H01R 9/2408 439/271
2018/0019544 A1 * 1/2018 Ishibashi ..... H01R 13/5219
2018/0069342 A1 * 3/2018 Kasar ..... H01R 24/28

* cited by examiner

ELECTRICAL CONNECTOR HAVING AN OUTER SHELL WITH A FRONT PORTION AND A REAR PORTION LARGER THAN THE FRONT PORTION

BACKGROUND OF THE INVENTION

1. Field of the Invention

The present invention relates to an electrical connector for inserting into a receiving space of a complementary connector through an insertion hole of an electronic device housing the complementary connector, wherein an outer shell of the electrical connector is so dimensioned in order to ensure a stable connection of the electrical connector to the complementary connector through the electronic device insertion hole.

2. Description of Related Art

In an arrangement of an electrical connector for inserting along a mating direction into a receiving space of a complementary connector through an insertion hole of an electronic device housing the complementary connector, the electronic device insertion hole has a dimension greater than that of the complementary connector receiving space so that the electrical connector may be easily inserted into the complementary connector for mating purpose. Since the insertion hole of the electronic device has a larger dimension and therefore a large gap is present between the inserted electrical connector and the electronic device, the inserted electrical connector may be subject to an undesired movement which affects electrical connection quality of the mated connectors.

SUMMARY OF THE INVENTION

An electrical connector for inserting along a mating direction into a receiving space of a complementary connector through an insertion hole of an electronic device that has a dimension greater than that of the receiving space, comprising: an insulative housing; a plurality of contacts secured to the insulative housing; and an outer shell enclosing the insulative housing, the outer shell including a front portion and a rear portion each having a respective lateral dimension measured along a transverse direction perpendicular to the mating direction, wherein the lateral dimension of the rear portion is greater than the lateral dimension of the front portion, the front portion is adapted to match the receiving space of the complementary connector and the rear portion is adapted to match the insertion hole of the electronic device, and the lateral dimension of the rear portion is less than the electronic device insertion hole dimension.

DETAILED DESCRIPTION OF THE PREFERRED EMBODIMENT

Figure 1:
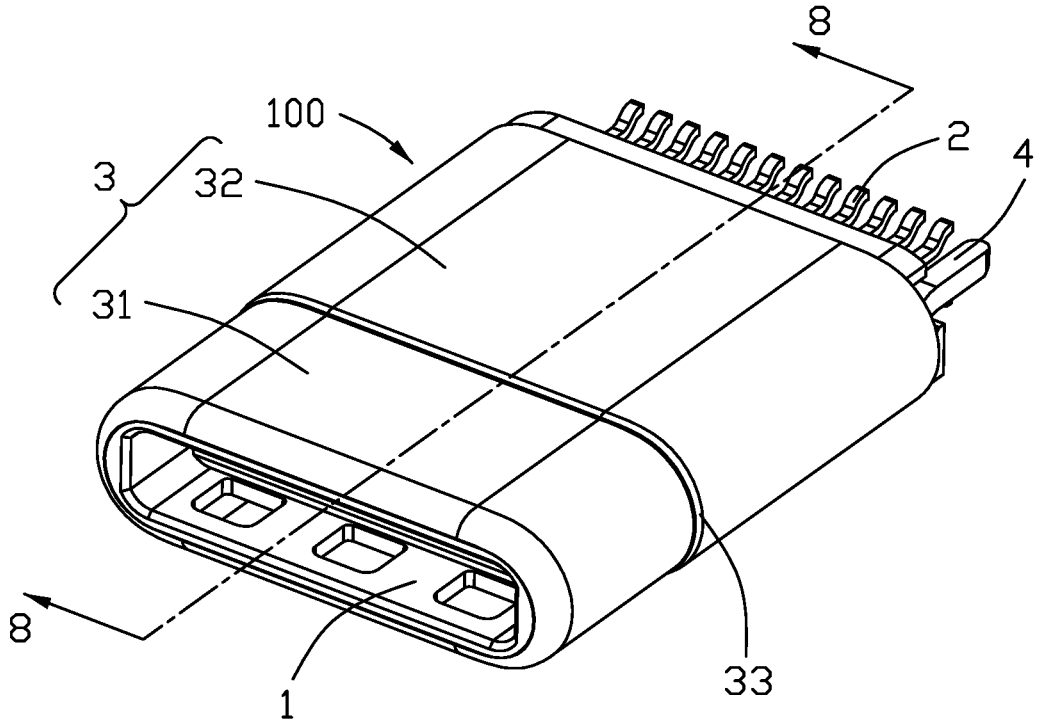
FIG. 1 is a perspective view of an electrical connector in accordance with the present invention.
Figure 2:
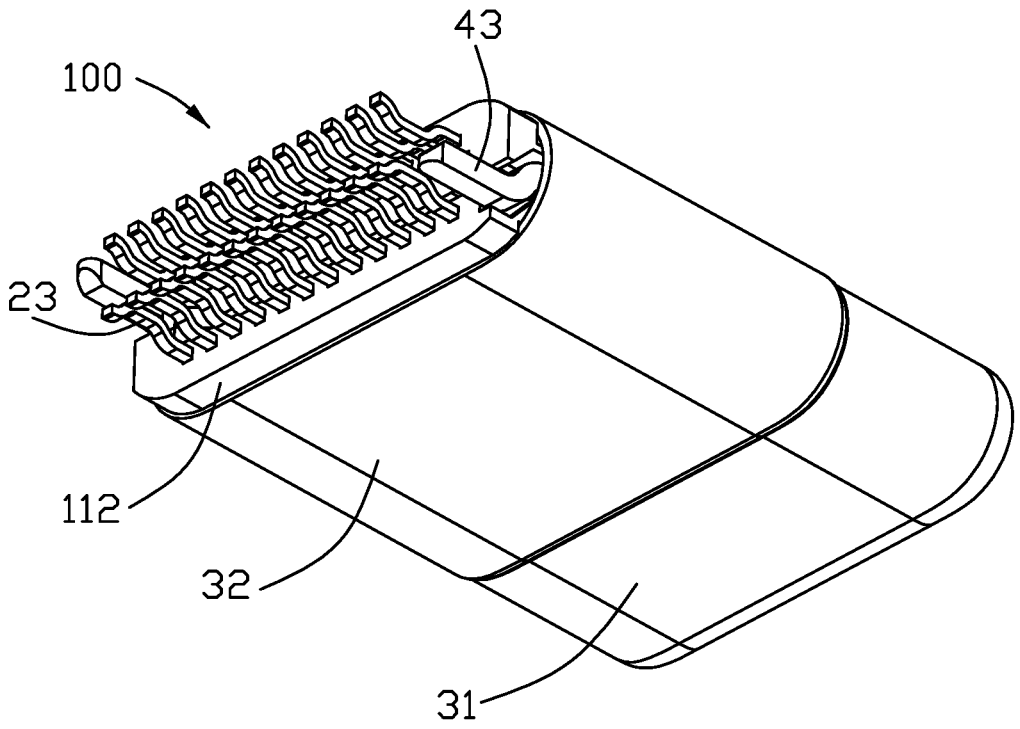
FIG. 2 is another perspective view of the electrical connector.
Figure 3:
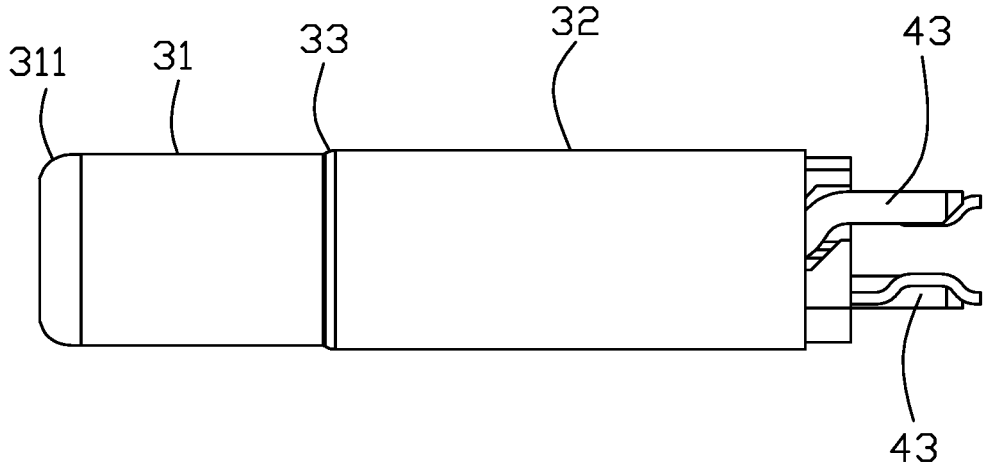
FIG. 3 is a side elevational view of the electrical connector.
Figure 4:
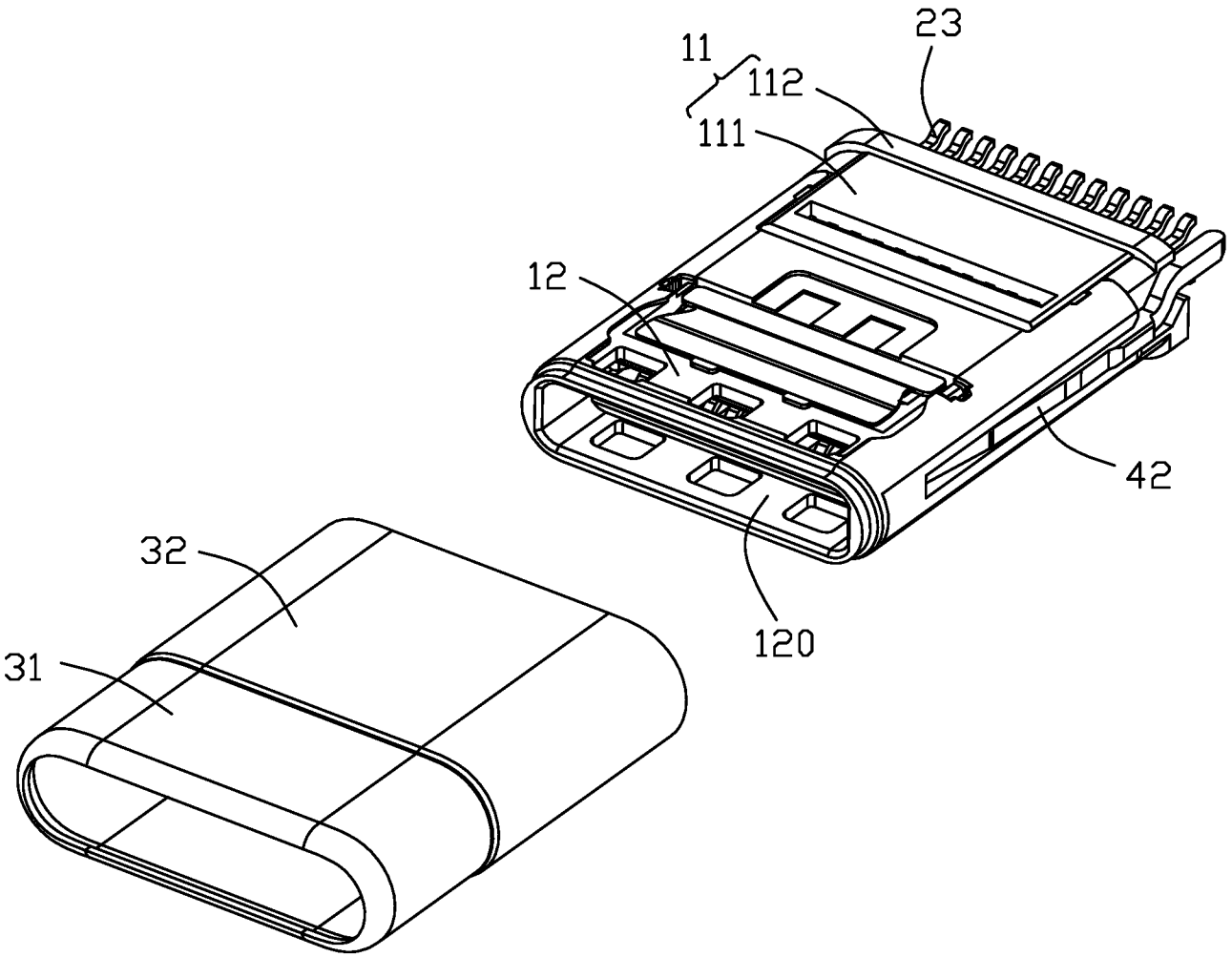
FIG. 4 is an exploded view of the electrical connector in FIG. 1.
Figure 5:
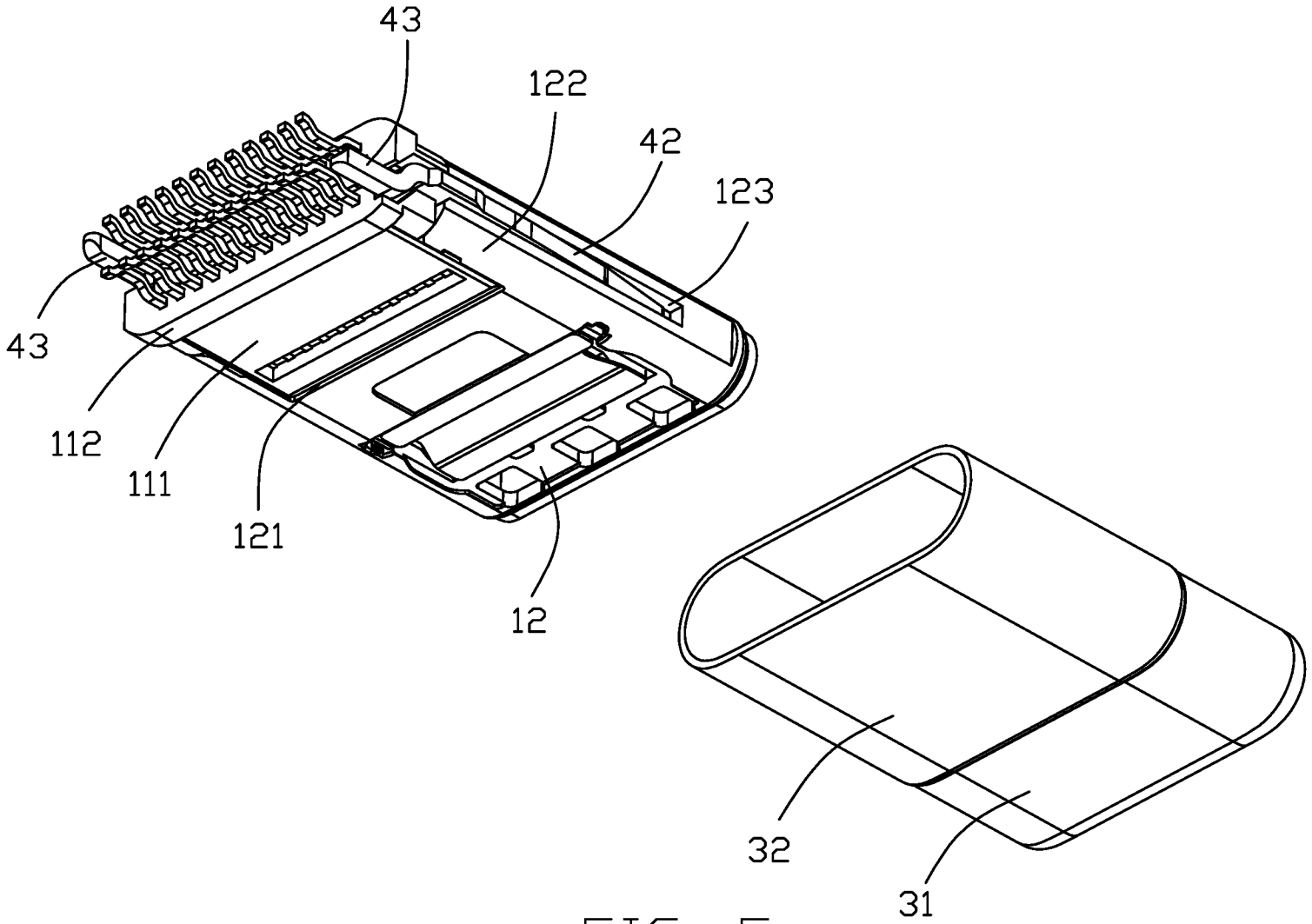
FIG. 5 is an exploded view of the electrical connector in FIG. 2.
Figure 6:
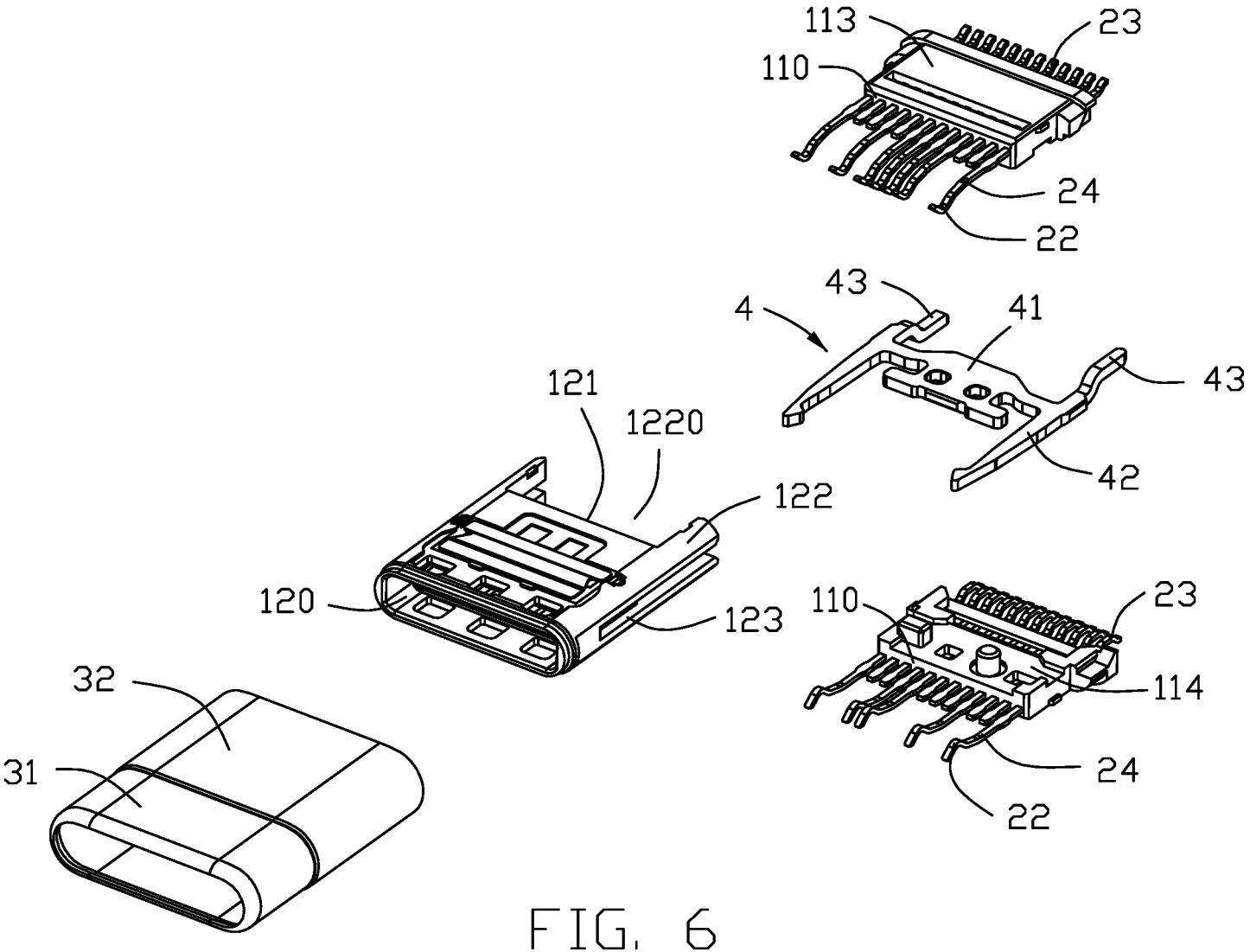
FIG. 6 is a further exploded view of the electrical connector in FIG. 4.
Figure 7:
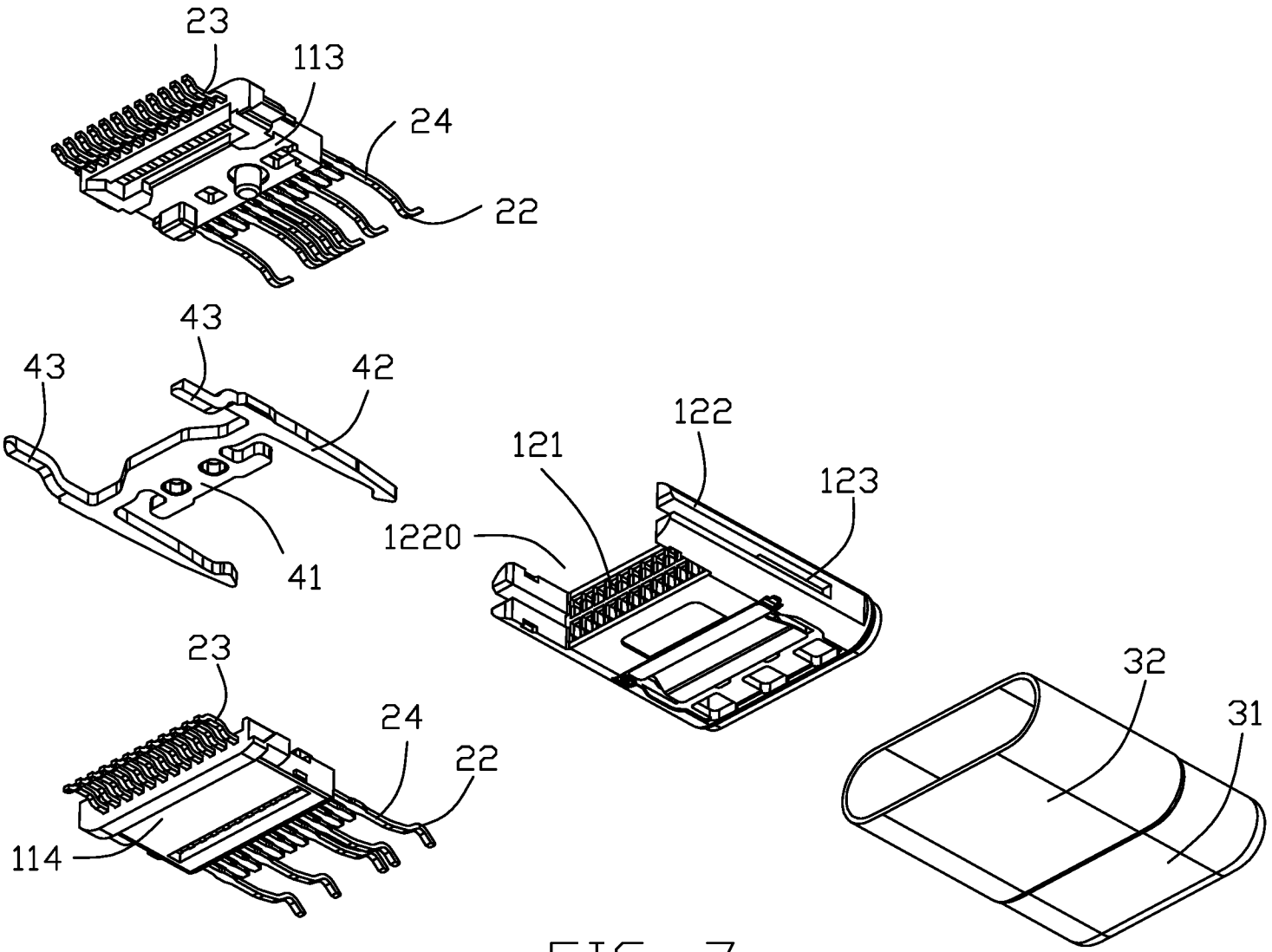
FIG. 7 is a further exploded view of the electrical connector in FIG. 5.
Figure 8:
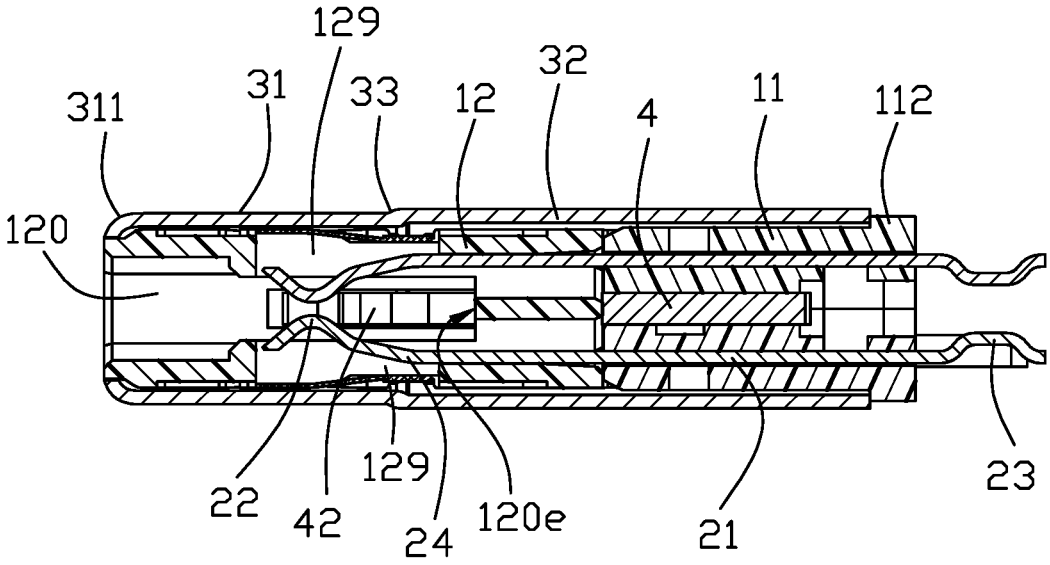
FIG. 8 is a cross-sectional view of the electrical connector taken along line A-A in FIG. 1.
Figure 9:
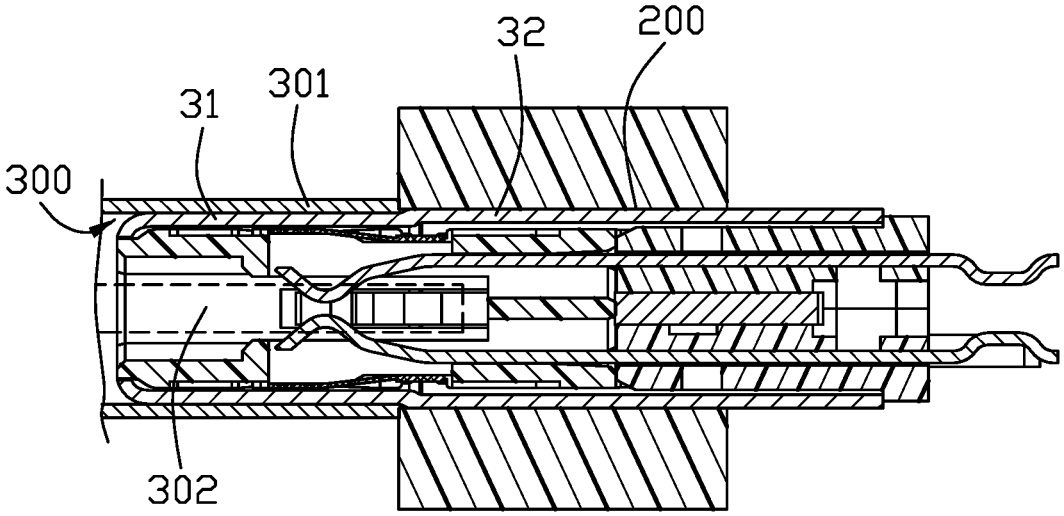
FIG. 9 is a view similar to FIG. 8 further showing the electrical connector inserted into a receiving space of a complementary connector through an insertion hole of an electronic device housing the complementary connector.

Referring to FIGS. 1-9, an electrical (plug/cable) connector 100 is designed to be inserted into a receiving space 300 of a complementary connector through an insertion hole 200 of an electronic device, e.g., cellphone, tablet, computer, that houses the complementary/receptacle connector. The electrical connector 100 shown is USB Type-C plug connector but may well be other types of connectors. The electrical connector 100 comprises an insulative housing 1, an upper and lower rows of contacts 2 secured to the insulative housing 1, and an metallic outer shell 3 enclosing the insulative housing 1. Each contact 2 has a contacting portion 22, a soldering portion 23, and an intermediate securing portion 21. The outer shell 3 may be made by a metal drawing process to form a seamless shell body, formed metallurgically, or stamped and formed with a connecting seam.

The receiving space 300 of the complementary connector formed by the metallic capsular shield 301 thereof, has a dimension less than that of the electronic device insertion hole 200 for ease of inserting the electrical connector 100 into the complementary connector along a mating direction. The outer shell 3 includes a front portion 31 and a rear portion 32 each having a respective lateral dimension measured along a transverse direction perpendicular to the mating direction. In this embodiment, the transverse direction refers to any radial direction measured along the vertical/up-and-down direction, the sideward/left-to-right direction or the oblique direction therebetween. The lateral dimension of the rear portion 32 is greater than the lateral dimension of the front portion 31; the front portion 31 is adapted to match the receiving space 300 of the complementary connector and the rear portion 32 is adapted to match the insertion hole 200 of the electronic device. The lateral dimension of the rear portion 32 is less than the dimension of the electronic device insertion hole 200. Each of the front portion 31 and the rear portion 32 has a substantially uniform lateral dimension.

The insulative housing 1 has a (rear) base 11 insert molded with the contacts 2 and a (front) housing unit 12 defining two rows of passageways 129 with therebetween a receiving chamber 120 which is adapted to receive a mating tongue 302 of the complementary connector. The securing portion 21 of the contact 2 has a spring arm 24 extending beyond a front face 110 of the base 11 into the corresponding passageway 129 with the corresponding contacting portion 22 extend into the receiving chamber 120. The housing unit 12 has a rear face 121 and a pair of fixing arms 122 defining an accommodating space 1220. The base 11 has a main body 111 received in the rear portion 32 and a rear step 112 abutting a rear end of the rear portion 32. The base 11 includes a first and second base parts 113 and 114 for the upper and lower rows of contacts 2, respectively. A shielding plate 4 is clamped between the first and second base parts 113 and 114. The shielding plate 4 has a main part 41, a pair of engaging arms 42, and a pair of soldering legs 43. Each engaging arm 42 is disposed in a slot 123 of a corresponding fixing arm 122.

A front end of the outer shell front portion 31 is substantially aligned with a front end of the housing unit 12. The front end of the outer shell front portion 31 has a rounded guiding surface 311. The outer shell 3 has a guiding/offsetting surface 33 formed between the front portion 31 and the rear portion 32. Notably, in a side view, the guiding surface 33 is located in front of the rear end 120*e* of the receiving chamber 120 while behind the contacting portion 22 of the contact 2 in the front-to-back direction. In addition, in this embodiment, the guiding surface 33 extends in a ring configuration so as to have the rear portion 32 is expanded circumferentially compared with the front portion 31. Anyhow, in other embodiments, the guiding surface may only formed only in the vertical direction or only in the sideward direction as long as having the rear portion expanded in either the vertical direction or the sideward direction to intimately confront the interior surface in the insertion hole 200 effectively.

What is claimed is:

1. An electrical connector for inserting along a mating direction into a receiving space of a complementary connector through an insertion hole of an electronic device that has a dimension greater than that of the receiving space, comprising:

an insulative housing;

a plurality of contacts secured to the insulative housing; and an outer shell enclosing the insulative housing, the outer shell including a front portion and a rear portion each having a respective lateral dimension measured along a transverse direction perpendicular to the mating direction; wherein the lateral dimension of the rear portion is greater than the lateral dimension of the front portion, the front portion is adapted to match the receiving space of the complementary connector and the rear portion is adapted to match the insertion hole of the electronic device, and the lateral dimension of the rear portion is less than the electronic device insertion hole dimension.

2. The electrical connector as claimed in claim 1, wherein the outer shell is metallic.

3. The electrical connector as claimed in claim 1, wherein the outer shell is made by a drawing process.

4. The electrical connector as claimed in claim 1, wherein each of the front portion and the rear portion has a substantially uniform lateral dimension.

5. The electrical connector as claimed in claim 1, wherein the outer shell comprises a guiding surface formed between the front portion and the rear portion.

6. An electrical connector assembly for use in an electronic device defining an insertion hole, comprising:

a complementary connector disposed in the electronic device and having a metallic shield located behind the insertion hole in a front-to-back direction and forming a receiving space therein; and a connector including:

an insulative housing forming a receiving chamber for receiving a mating tongue of the complementary connector;

a plurality of contacts retained in the housing with contacting portions extending into the receiving chamber; and a metallic outer shell enclosing the housing and defining a front portion and a rear portion along said front-to-back direction; wherein the front portion is received within the receiving space of the complementary connector, and the rear portion is received within the insertion hole of the electronic device; wherein an offsetting surface is formed between the front portion and the rear portion in the front-to-back direction to have the rear portion larger than the front portion transversely.

7. The electrical connector assembly as claimed in claim 6, wherein in a side view, the offsetting surface is located in front of a rear end of the receiving chamber in the front-to-back direction.

8. The electrical connector assembly as claimed in claim 7, wherein in said side view, the offsetting surface is located behind the contacting portions of the contacts in the front-to-back direction.

9. The electrical connector assembly as claimed in claim 6, wherein the offsetting surface extends in a ring configuration.

10. The electrical connector assembly as claimed in claim 6, wherein the receiving space is smaller than the insertion hole transversely.

11. The electrical connector assembly as claimed in claim 6, wherein the rear portion of the metallic outer shell of the connector extends out of the insertion hole.

12. The electrical connector assembly as claimed in claim 6, wherein the complementary connector is a receptacle connector while the connector is a cable connector.

13. The electrical connector assembly as claimed in claim 6, wherein the housing includes a rear base with which the contacts are integrally formed, and a front housing unit with two rows of passageways to receive the contacts therein, and the receiving chamber is formed in the housing unit.

14. The electrical connector assembly as claimed in claim 6, wherein both the outer shell of the connector and the shield of the complementary connector are capsular.

15. An electrical connector comprising:

an insulative housing forming a receiving chamber for receiving a mating tongue of a complementary connector;

a plurality of contacts retained in the housing with contacting portions extending into the receiving chamber; and a metallic outer shell enclosing the housing and defining a front portion and a rear portion along a front-to-back direction; wherein the front portion is configured to be received within a receiving space of the complementary connector, and the rear portion is configured to be received within an insertion hole of an electronic device wherein the complementary connector is located in the electronic device and behind the insertion hole; wherein an offsetting surface is formed between the front portion and the rear portion in the front-to-back direction to have the rear portion larger than the front portion transversely.

16. The electrical connector as claimed in claim 15, wherein in a side view, the offsetting surface is located in front of a rear end of the receiving chamber in the front-to-back direction.

17. The electrical connector as claimed in claim 16, wherein in said side view, the offsetting surface is located behind the contacting portions of the contacts in the front-to-back direction.

18. The electrical connector as claimed in claim 15, wherein said offsetting surface is of a ring configuration.

19. The electrical connector as claimed in claim 18, wherein said ring configuration is complete.

20. The electrical connector as claimed in claim 15, wherein the housing includes a rear base with which the contacts are integrally formed, and a front housing unit with two rows of passageways to receive the contacts therein, and the receiving chamber is formed in the housing unit.

* * * * *